US006988725B2

(12) United States Patent
Rapkin

(10) Patent No.: US 6,988,725 B2
(45) Date of Patent: Jan. 24, 2006

(54) METHOD FOR REGISTERING SHEETS IN A DUPLEX REPRODUCTION MACHINE FOR ALLEVIATING SKEW

(75) Inventor: Alan E. Rapkin, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 68 days.

(21) Appl. No.: 10/701,838

(22) Filed: Nov. 5, 2003

(65) Prior Publication Data

US 2004/0251611 A1 Dec. 16, 2004

Related U.S. Application Data

(60) Provisional application No. 60/423,669, filed on Nov. 5, 2002.

(51) Int. Cl.
*B65H 7/02* (2006.01)

(52) U.S. Cl. ..... 271/227; 271/65; 271/186; 399/394; 399/395; 399/401

(58) Field of Classification Search ..... 271/265.02, 271/184, 902, 227, 236, 65, 186, 291; 399/394, 399/395, 401
See application file for complete search history.

(56) References Cited

U.S. PATENT DOCUMENTS 4,438,917 A * 3/1984 Janssen et al. ..... 271/227
4,457,506 A * 7/1984 Ashbee et al. ..... 271/3.01
4,511,242 A * 4/1985 Ashbee et al. ..... 399/395
4,971,304 A * 11/1990 Lofthus ..... 271/227
5,725,211 A * 3/1998 Blanchard et al. ..... 271/265.02
5,758,251 A * 5/1998 Takahashi et al. ..... 399/395
5,930,577 A * 7/1999 Forsthoefel et al. ..... 399/401
6,141,526 A * 10/2000 Ikeda ..... 399/395
6,161,831 A * 12/2000 Kusakabe et al. ..... 271/186
6,324,377 B2 * 11/2001 Ando et al. ..... 399/395
6,340,984 B1 * 1/2002 Ui et al. ..... 347/139
6,373,042 B1 * 4/2002 Kretschmann et al. ... 250/208.1
6,374,075 B1 * 4/2002 Benedict et al. ..... 399/395
6,490,421 B2 * 12/2002 McIntyre ..... 399/15
6,533,268 B2 * 3/2003 Williams et al. ..... 271/228
6,705,786 B2 * 3/2004 Trovinger ..... 400/645.3
6,731,887 B1 * 5/2004 Wibbels et al. ..... 399/45
6,813,451 B2 * 11/2004 Wibbels ..... 399/45
6,866,260 B2 * 3/2005 Williams et al. ..... 271/227
6,895,210 B1 * 5/2005 Quesnel ..... 399/395
6,920,307 B2 * 7/2005 Howe ..... 399/395

FOREIGN PATENT DOCUMENTS

JP 60002543 A * 1/1985

* cited by examiner

*Primary Examiner*—Donald P. Walsh
*Assistant Examiner*—Matthew J. Kohner

(57) ABSTRACT

A method of registering a sheet in a duplex copier to alleviate the misalignment between the images copied on the front and back of the same sheet and to compensate for paper cut tolerances. The error angle of skew between a target angle, e.g. 90°, and the trailing edge of the sheet is measured and stored during a first pass. When the same sheet is fed through a second pass, the error angle is retrieved and the target angle is adjusted to compensate for the skew error of the first pass so that any misalignment between front and back images is substantially improved over systems that register images to the sheet without any knowledge of the location of the opposite side image.

5 Claims, 5 Drawing Sheets

METHOD FOR REGISTERING SHEETS IN A DUPLEX REPRODUCTION MACHINE FOR ALLEVIATING SKEW

FIELD OF THE INVENTION

The present invention relates to registering sheets of a copy medium in a duplex reproduction machine, e.g. copier, to alleviate the skew of the copied images on the sheets and in one of its aspects relates to a method for registering sheets of a copy medium (e.g. paper) in a duplex copier or the like to substantially match the skew of an image on one side of a sheet to the skew of an image on the other side of that sheet thereby better aligning the images on the front and back of each sheet with each other which, in turn, significantly improves the esthetic quality of the finished sheet.

BACKGROUND OF THE INVENTION

One type of well-known reproduction machines (e.g. copiers, etc.) uses a continuous loop of a photoconductor film to transfer the image to be copied onto a sheet of a copy medium. The film is charged and passes through an input section where the desired information (hereinafter "image") is projected onto the charged film. The film then moves through a developing section where toner is applied to the charged image, and on through an image transfer section where the toner is transferred onto a copy medium. The toner (i.e. image) is then fixed (i.e. fused) to the copy by the application of heat/pressure.

Typically, the copy medium is cut sheets of paper or transparent material (hereinafter referred to as "sheet(s)"). As is recognized in the art, it is extremely important that each sheet be accurately aligned (i.e. registered) relative to the film when an image is transferred from the film onto its respective sheet. That is, if the axis or centerline of a sheet is "skewed" in relation to the film when the image is transferred, the image will be skewed on the sheet, which in turn, can seriously detract from the esthetic quality of the copy. While small angles of skew (i.e. "skew angle") may be tolerated since they are not readily discernable to the naked eye, larger skew angles (e.g. >about 0.1 degrees) become quite noticeable and result in unacceptable copies for most users.

Even the smaller skew angles are concern in high-quality, duplex printing/copying operations wherein an image is to be copied onto both sides of a sheet. That is, in high quality duplex reproduction machines (e.g. copiers/printers), it is important that the image on one side of a sheet substantially align with the image on the other side of that sheet. For example, in book printing and the like, the margins of the text on one side of a page should align with the margins of the text on the other side of that page so that a reader will not be distracted by the misaligned print which almost always faintly "shows through" unless the sheet material is unusually thick.

In standard book printing and similar operations, aligning the images on both sides of a sheet is typically accomplished, by using precision-cut, rectangular sheets and providing sophisticated registration mechanisms as part of the sheet feed devices. Such techniques, if applied routinely to "on-demand" copiers where the sheets are not always mill-cut would substantially increase the price thereby making such copiers unavailable to a large portion of the market. Accordingly, the proper registration of the sheets, especially in every-day, duplex copy operations, still needs to be addressed.

Several apparatuses have been proposed for registering the sheets in a copier as the sheets are individually fed into the image transfer section of a copier or the like to alleviate skewing of the images on the sheets. For example, see U.S. Pat. No. 5,322,273, issued Jun. 21, 1994, and the references cited and discussed therein. In U.S. Pat. No. 5,322,273, a sheet registration mechanism is disclosed for aligning each sheet during multi-pass, copy operation. The registration mechanism is comprised of two pairs of sensors, spaced on either side of the center line of the sheet, which sense the leading edge of the sheet to start and stop stepper motors which, in turn, operate friction rollers to compensate for the skew of the sheet in relation to its center line.

While these prior-art registration mechanisms have been successful in most applications, they fail to address the problems involved in aligning the images on both sides of a sheet as are present in duplex copying operations. That is, while mechanisms such as that shown in U.S. Pat. No. 5,322,273, are effective in reducing the skew angle of the image on a sheet to one which is normally indiscernible to the naked eye, these mechanisms are not perfect and a small skew angle may remain, even after a sheet has passed through the registration mechanism, especially if the sheet is not perfectly cut.

In duplex copying/printing operations, an image, e.g. text, is copied onto one side and then the sheet is turned over and an image, e.g. text, is copied onto the other. As explained above, it is esthetically important that these images (the effective boundaries thereof) substantially align with each other once copied on a sheet. That is, the images, if skewed at all, should be skewed at the same angle with respect to their respective lead edges so that one side does not produce a distracting "phantom" image with respect to the other during normal viewing.

If a residual skew angle exists after a sheet has been initially registered for copying on a first side and is not compensated for, the skew angle will be repeated on the other side, thereby effectively doubling the amount of skew between the images on the respective sides of the sheet. Again, while the residual skew angle may be small enough not to present any problems when viewing only one side of the sheet, the combination of the residual angles on both the front and the back of the sheet produces a highly, noticeable and usually objectionable phantom profile of images when a duplex copy is viewed from either side.

SUMMARY OF THE INVENTION

The present invention provides a method of registering a sheet of a copy medium in a duplex reproduction machine to alleviate the misalignment between the respective images copied on the front and back of a particular sheet. Basically, the method involves the measuring of the error angle of skew between a registration target angle, e.g. 90°, and the trailing edge of said sheet during a first pass before a first image is reproduced on said front of said sheet.

The registration target angle for that particular sheet is then adjusted during a second pass to compensate for the error angle of skew measured during the first pass so that any misalignment between said first image and a second image reproduced on the back of said sheet is maintained within tolerances acceptable to a user.

More specifically, the present invention provides a method for alleviating the misalignment between images reproduced on the front and back of the same sheet in a duplex reproducing machine. The misalignment or "skew" between images is alleviated by measuring the error angle of skew between a desired, registration target angle of 90° and the trailing edge of the sheet after the sheet has passed through a sheet registration mechanism during a first pass through the machine.

A signal representative of said measured error angle of skew for that particular sheet is generated and is stored along with the identification of the sheet. When the same sheet is fed back through the duplex path for a second pass, the sheet is identified and the signal for that sheet is retrieved and is used to set a new registration target angle to be used by the sheet registration mechanism. This new registration target angle (e.g. 90°+skew error angle on first pass) compensates for the skew error of the first pass and thereby cancels or at least effectively halves the misalignment of images that would have otherwise been present but for the present invention.

Preferably, the error angle of skew is measured during the first pass by a pair of sensors in the sheet registration mechanism which are positioned near the top and the bottom of the sheet so that the sensors detect the upper and lower portions, respectively, of said trailing edge of said sheet as said sheet passes over said sensors. The measurement of said error of skew is derived from the difference of when respective sensors detect said upper and lower portion of said trailing edge of said sheet and is used to determine the new sheet registration target angle for the sheet registration mechanism during the second pass of the sheet.

The present invention effectively halves any skew error (i.e. misalignment) between the images on the front and back of a particular sheet that may otherwise be present in a duplex reproduction operation without requiring finer resolution stepper motors or the like. This can significantly reduce the costs of the duplex reproduction machine. The present method also compensates for paper cut tolerances in reducing the front to back skew between images.

BRIEF DESCRIPTION OF THE DRAWINGS

The actual construction operation, and apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents that may be included within the spirit and scope of the invention, as defined by the appended claims.

DESCRIPTION OF THE PREFERRED EMBODIMENTS

Figure 1:
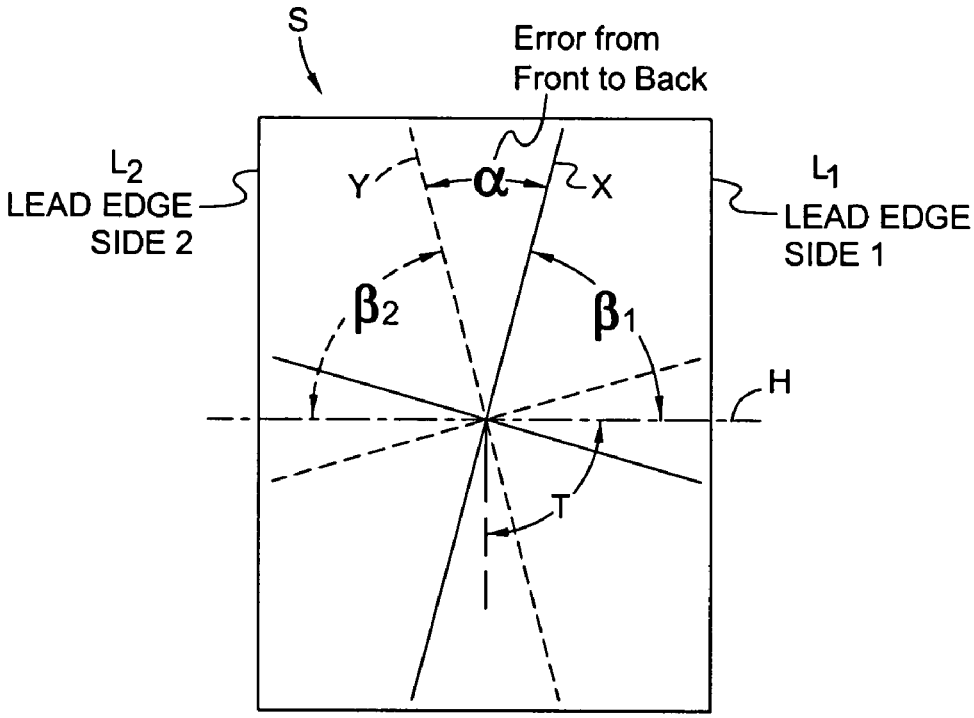
FIG. 1 is a perspective view of a typical sheet of copy medium (e.g. paper) used in a duplex copier/printer machine illustrating the skewing of respective front and back images which may occur with respect to the edges of the sheet.
Figure 2:
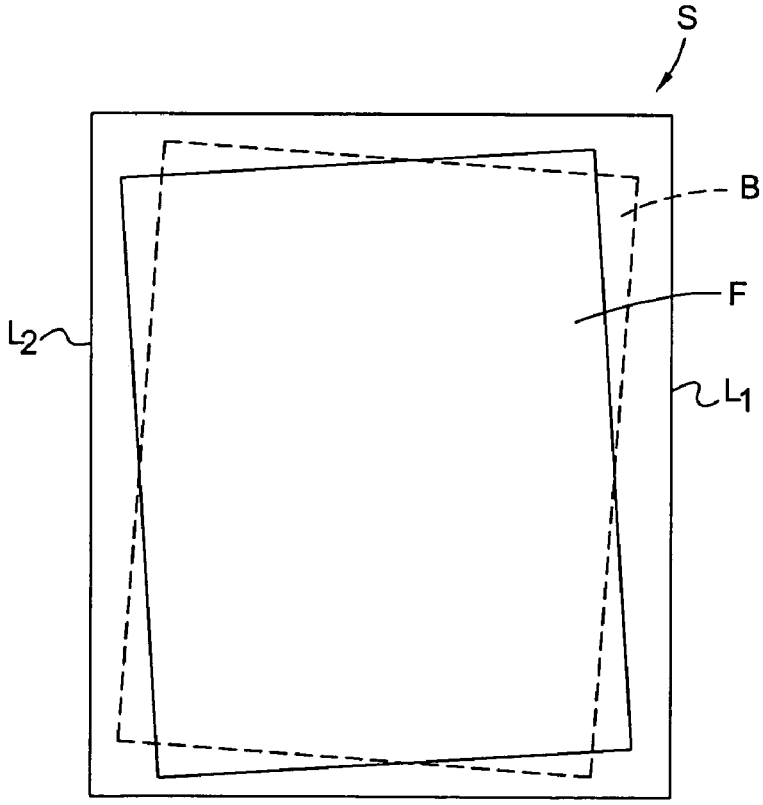
FIG. 2 is a perspective view of the sheet of FIG. 1, slightly enlarged, illustrating misaligned profiles of images on the front and back of the sheet resulting from the skewing of the images.

Referring now to the drawings, FIG. 1 is representative of a sheet S of copy medium (e.g. paper) which, in turn, is to be used in a duplex copier/printer or the like (hereinafter collectively referred to as "copier") wherein an image is to be transferred from a photoconductor member (e.g. film) onto both the front and the back of the sheet. As will be understood in the art, it is important in quality copying/printing operations that the profiles (i.e. boundaries) of the front and back images F, B (FIG. 2) be in substantial alignment to prevent an undesirable appearance when sheet 10 is viewed from either side. That is, if the image F (solid lines) on the front side of sheet S is misaligned (i.e. skewed) with relation to image B (dotted lines) on the back of sheet S, then as illustrated in FIG. 2, a phantom image (i.e. dotted lines B) will be faintly visible from the front side, and vice versa, which can be distracting to a viewer (e.g. reader) when viewing sheet S.

Figure 5:
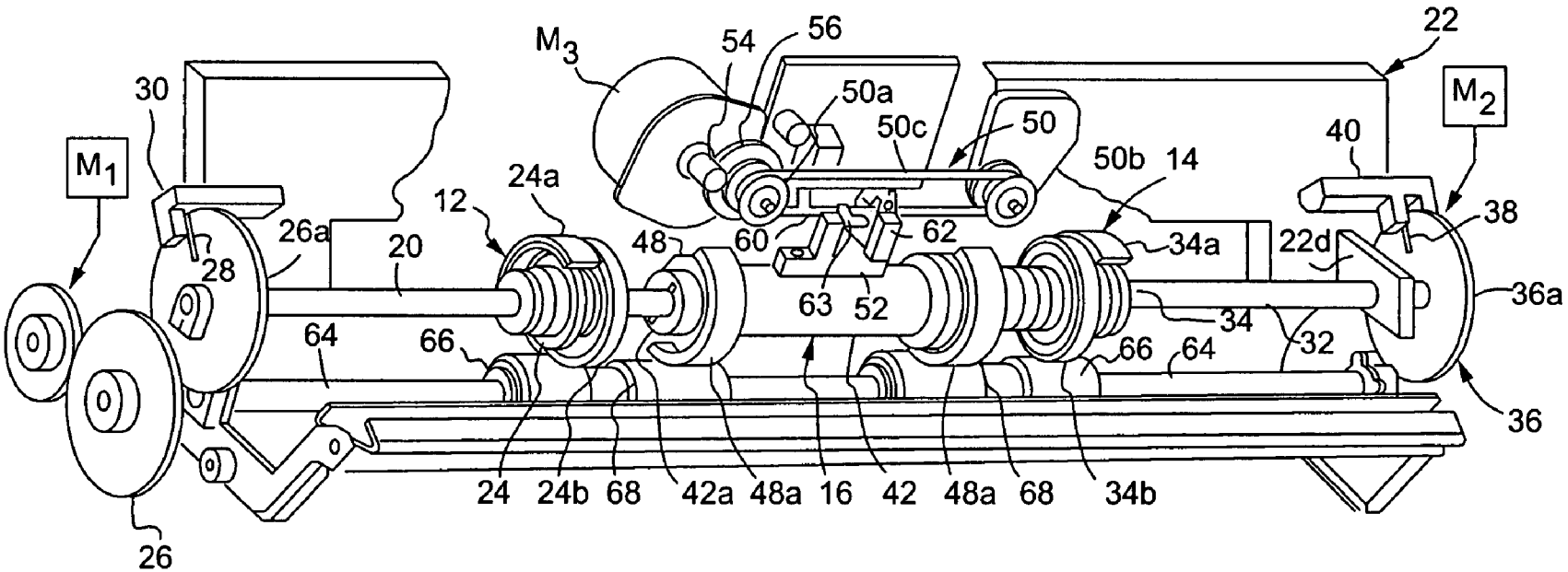
FIG. 5 is a perspective view of the structural configuration of the sheet registration device of FIG. 3.
Figure 6:
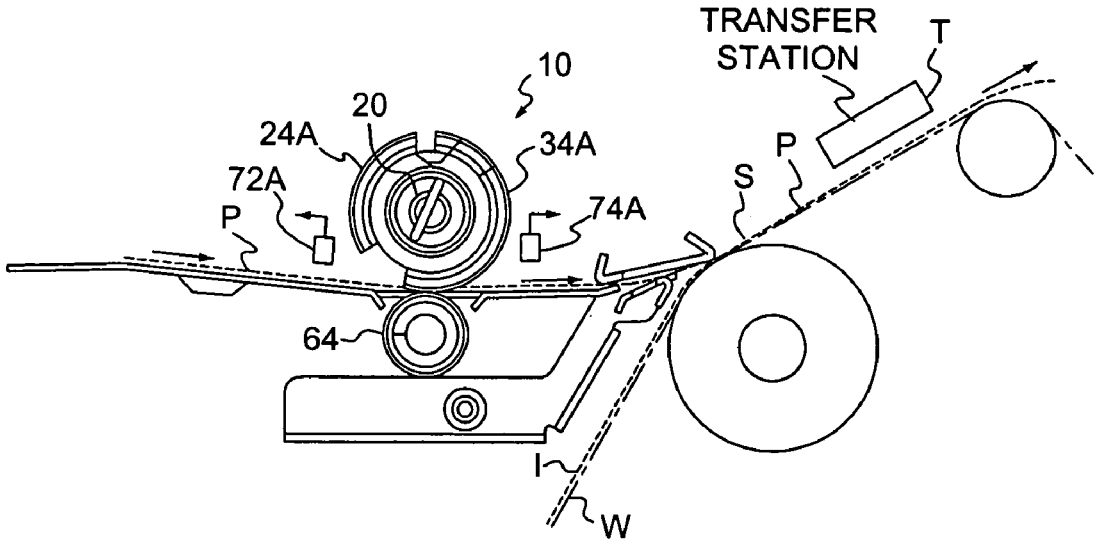
FIG. 6 is a side elevational view of the sheet registration apparatus of FIG. 5, partly in section and with portions removed to facilitate viewing.

Typically, a sheet registration apparatus or mechanism is used in copiers to alleviate the skew of sheet S before it enters the image transfer section of the copier. This is done in order to align the sheet with its respective image on the photoconductor before the image is transferred to the sheet. One known sheet registration mechanism 10 of this type is shown in FIGS. 5 and 6 and is fully disclosed and discussed in U.S. Pat. No. 5,322,273, issued Jun. 21, 1994, and which, in turn, is incorporated herein in its entirety by reference. Sheet registration mechanism 10 and its operation will be discussed in more detail below.

Sheet S, as it initially enters sheet registration mechanism 10, is likely to have a random, relatively large skew error angle equal to (90°−β; e.g. ±2°), see FIG. 1). This relatively large skew angle is typically caused by the way the sheets may be loaded into the supply trays and/or from the handling of the sheet within the copier as it is transported from the supply tray towards the image transfer section. The registration mechanism 10, as fully described in U.S. Pat. No. 5,322,273, registers or "deskews" each individual sheet before that particular sheet passes into the image transfer section to compensate for a major portion of any skew angle that may be present at that point. Unfortunately, however, registration mechanisms of this type are not perfect.

That is, while any skew angle β is made closer to the target angle of 90° by sheet registration mechanism 10, there exists the possibility that some residual, skew angle, albeit small (e.g. ±0.1°) will remain after sheet S exits mechanism 10. This small, residual skew angle is generally acceptable for most single side copies since the misalignment of the image within such tolerances is not readily discernable to the naked eye. However, in duplex operations where an image is to be copied onto both the front and back of sheet S, any residual skew angle from the first pass, if not compensated for, may cause a lack of parallelism (i.e. alignment) between the images on the two sides (see FIG. 2 which is highly exaggerated for clarity). This misalignment between images can be very noticeable and hence, unacceptable to a user, especially when sheet S is held up to the light.

Saying it a different way, if the image F on side 1 has a skew angle of 0.1° relative to its lead edge $L_1$ (as measured relative to a desired, registration target angle T of 90°, see FIG. 1), the image B on side 2 will look bad with respect to image F on side 1 even if image B is perfectly square to the lead edge $L_2$ of sheet S. Only if the image B is skewed a like angle of 0.1° in the opposite direction on side 2 will it substantially align with image F on side 1. Further, if sheet S is not a precise square cut, image B on side 2 will appear to be skewed relative to image F on side 1 even if image F is perfectly aligned with its lead edge $L_1$. This is due to the fact that image F is aligned with leading edge $L_1$ while image B is aligned with the opposite edge $L_2$ of sheet S when the respective images are transferred onto their respective sides.

The present invention may be further understood by referring to FIG. 1 wherein sheet S has an image shown in solid lines (centerline X) on the front side and an image shown in dotted lines (centerline Y) on the back side. As shown in FIG. 1, angle $\beta_1$ would be 90° to the horizontal H if image X had zero skew on sheet S; i.e. angle $\beta_1$ would be equal to target angle T. Likewise, angle $\beta_2$ would be 90° to the horizontal H also equal to target angle T if the image on the back side also had zero skew. In this case, the images would be aligned when viewed from either side and the angle $\alpha$ would be zero.

However, to better illustrate the present invention, both angles $\beta_1$ and $\beta_2$ in FIG. 1 are shown as having values other than the target angle T of 90°. That is, both images are skewed relative to each other so that the misalignment between the two would readily be visible when light passes through sheet S. The apparent error (i.e. skew angle) between the front and back images then becomes equal to "$\alpha$" wherein:

$$\alpha=(90°-\beta_1)+(90°-\beta_2) \text{ or } 180°-(\beta_1+\beta_2)$$

Again, if $\beta_1$ and $\beta_2$ were 90°, the skew would be zero on both side 1 and side 2 and $\alpha$ would also be zero. However, more realistically, the residual angle $\beta$ will be a value other than 90°. For example, if $\beta_1$ is 89.9° and $\beta_2$ is also equal to 89.9°, then $\alpha$ is equal to 0.2°. The only way $\alpha$ can be zero in this scenario is for $\beta_2$ to become 90.1°. It is pointed out that minimizing $\alpha$ is important in high quality printing/copying since even small values of $\alpha$ are very noticeable and may seriously detract from the finished product.

In accordance with the present invention, the intent is to get both the $\beta$ angles as close to the target angle T of 90° as possible so that the images on both sides will align within acceptable tolerances (e.g. ±0.1°). Basically, this is accomplished by sensing the trail edge of sheet S as it exits registration mechanism 10 and enters the image transfer section of the copier. Any residual skew angle for that particular sheet S is measured and a signal, representative of this measurement is stored in a data storage device along with the identification of that particular sheet (i.e. number of the sheet) for future retrieval. This will be discussed in greater detail below.

When that particular sheet (identified by its number) is fed back for a second pass through the copier, the skew angle measurement for that sheet is retrieved from the data storage device and is supplied to the control for the sheet registration mechanism. The residual skew angle data is then used to set a new target angle for $\beta_2$ (i.e. $90°+\beta_1$). Since the error angle for side 1 is always $(90°-\beta_1)$ the new target angle for side 2 will always be $(90°+\beta_1)$ instead of 90° as is the case in the prior art devices of this type. By setting this new target angle, a reduced value $\alpha$ results, which will be within the acceptance tolerance of the copies (e.g. ±0.1°).

The present invention is also applicable on trapezoidal sheets wherein side $L_1$ and side $L_2$ are not parallel (e.g. some non-mill cut paper or the like). The process is the same as set forth and discussed above. That is, $\beta_1$ is set at a target angle T of 90° while the target for $\beta_2$ is shifted depending on the skew measurement from the trail, non-parallel side, (e.g. $L_2$) of side 1.

Figure 4:
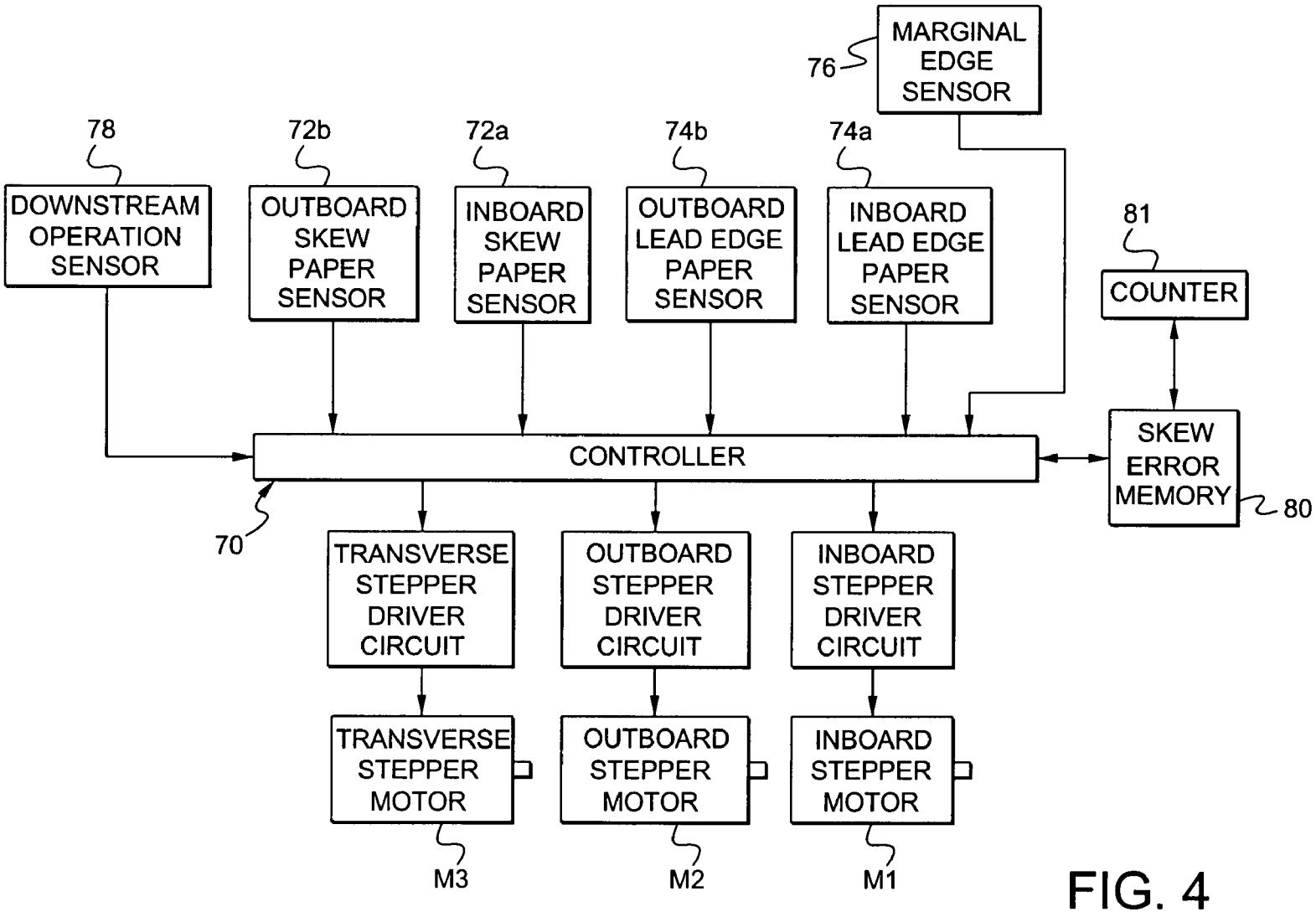
FIG. 4 is a schematic diagram of the controls for the sheet registration apparatus of FIG. 4.

Reference will now be made to FIGS. 4–6, which illustrate the physical components of the registration mechanism 10 of the present invention. Mechanically (FIGS. 5 and 6), sheet registration mechanism 10 is basically the same as that disclosed and described in U.S. Pat. No. 5,322,273, which is incorporated herein in its entirety by reference. More specifically, sheet registration mechanism 10 is comprised of first and second independently driven roller assemblies 12, 13, and a third roller assembly 16.

The first roller assembly 12 includes a first shaft 20, which is mounted in bearings 22*a*, 22*b* in frame 22. A first urging roller 24 is fixed on shaft 20 and has an arcuate segment 24*a* extending around about 180° of the roller. A first stepper motor $M_1$ drives first shaft 20 through gear train 26, which includes an intermediate gear 26*a*. Gear 26*a* has indicia 28 thereon which, in turn, is detectable by a suitable sensor 30 (e.g. optical, mechanical, etc.) to thereby position first urging roller 24 in its start position.

Second roller assembly 14 is comprised of a second shaft 32 which is mounted in bearings 22*c*, 22*d* in frame 22 and which is substantially coaxial with the longitudinal axis of first shaft 20. A second urging roller 34 is fixed to shaft 32 and has an arcuate segment 34*a* extending 180° around roller 34. A second independent stepper motor $M_2$ drives the second shaft 32 through gear train 36, which includes an intermediate gear 36*a*. Gear 36*a* has indicia 38 thereon which, in turn, is detectable by a suitable sensor 40 (e.g. optical, mechanical, etc.) to thereby position first urging roller 34 in its start position.

Third roller assembly 16 includes a tube 42 surrounding first shaft 20 and is mounted for movement longitudinally with respect to the axis of shaft 20. A pair of third urging rollers 48 having arcuate segments 48*a* (which are offset from segments 24*a*, 34*a*) are fixed on the first shaft 20 for rotation therewith. A third stepper motor $M_3$ drives tube 42 through pulley and belt arrangement 50 which, in turn, is comprised of a pair of pulleys 50*a*, 50*b* rotatably mounted on frame 22. Belt 50*c* loops pulleys 50*a*, 50*b* and is attached to bracket 52 that is connected to tube 20. When stepper motor $M_3$ is selectively actuated, gear 56 will move belt 50*c*, hence tube 20 in either direction with respect to shaft 20.

A plate 60 is fixed to frame 22 and carries an indicia 63 which is detectable by a suitable sensor 62 to locate third roller assembly 16 in its start position. Pairs of idler rollers 66, 68 are rotatably mounted on shaft 64 located below the path P of sheet S and are effectively aligned with first urging roller 24 and second urging roller 34 and with third urging rollers 48, respectively.

In order to alleviate skew from a particular sheet S as it moves along its path P, the above-described elements of sheet registration mechanism 10 are controlled by logic and control unit 70 (FIG. 4). As will be understood in the art, control unit 70 may be a microprocessor which is programmed to receive signals from a plurality of sensors (described below), process those signals, and then output signals for the real-time control of the mechanism 10, i.e. stepper motors $M_1$, $M_2$, $M_3$) as will be described further below.

Figure 3:
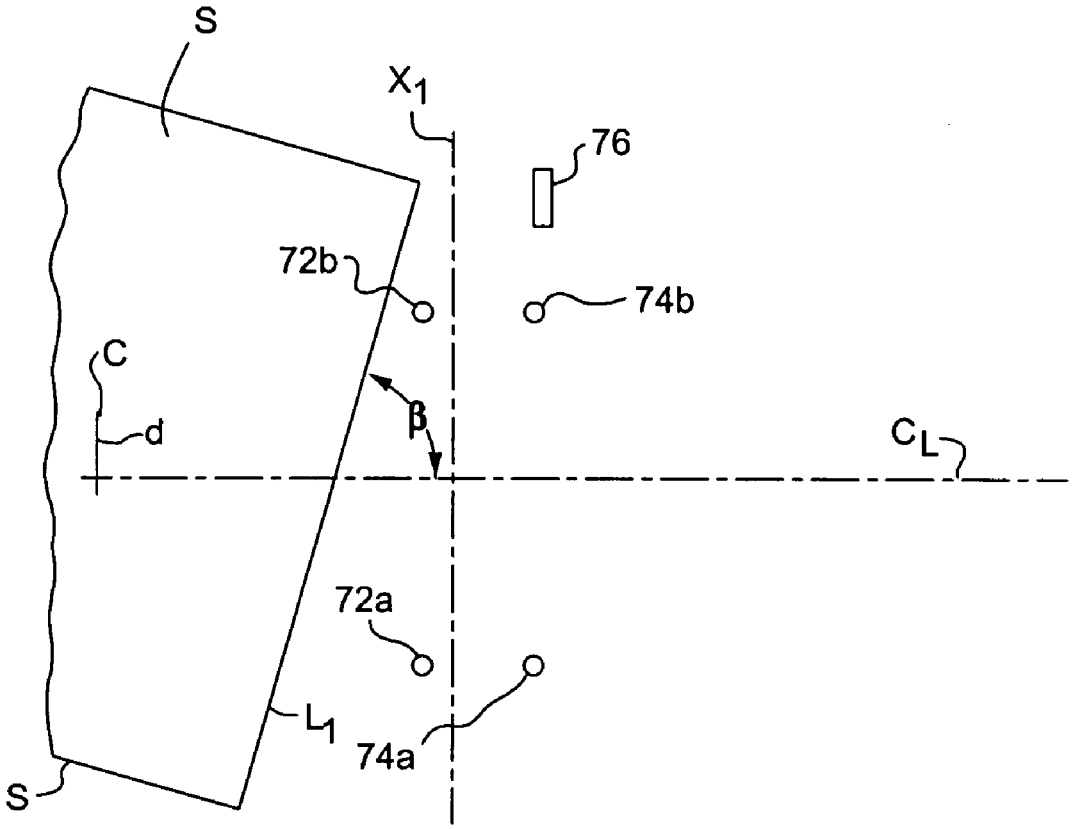
FIG. 3 is a top schematic illustration of the sheet of FIG. 1 as it is transported through a sheet registration apparatus in accordance with the present invention.

For the operation of the present invention, reference is now made to FIGS. 3 and 4. As sheet S moves along path P and into sheet registration mechanism 10, it is illustrated as having a skew angle $\beta$ with respect to centerline $C_L$ of path P and its center C spaced a distance "d" from $C_L$. A first pair of sensors 72*a*, 72*b* (e.g. optical, mechanical, or the like) is located on either side of $C_L$ (i.e. near the top and the bottom of sheet S) and upstream of plane $X_1$, which in turn, is defined as including the longitudinal axes of the urging rollers 24, 34, and 48 and idler rollers 66 and 68.

When sensor 72*a* detects the upper or top portion of lead edge $L_1$ of sheet S, it generates and sends a signal to control unit 70, which in turn, starts stepper motor $M_1$. In a like manner, when sensor 72*b* detects the lower or bottom portion of lead edge $L_1$ of sheet S, the signal generated thereby starts stepper motor $M_2$. Motor $M_1$ will ramp up to speed and the arcuate segment on urging roller 24 will engage the sheet to continue the transport of sheet S along path P. Likewise, stepper motor $M_2$ will ramp up to speed and the arcuate segment on urging roller 34 will also engage the sheet. As seen in FIG. 3, if sheet S is skewed, sensor 72*b* will detect lead edge $L_1$ before sensor 72*a* so stepper motor $M_2$ will start before motor $M_1$.

A second set of sensors 74*a*, 74*b* (e.g. optical, mechanical, or the like) is located on either side of $C_L$ (i.e. near the top and bottom of sheet S) and downstream of plane $X_1$. When sensor 74*a* detects the upper or top portion of lead edge $L_1$ of sheet S, it generates a signal, which stops stepper motor $M_1$. In a like manner, sensor 74*b* stops stepper motor $M_2$ when it detects the lower or bottom portion of lead edge $L_1$ of the sheet. Again, if sheet S is skewed, sensor 74*b* will detect the lead edge before sensor 74*a* whereby stepper motor $M_2$ will stop before motor $M_1$. Accordingly, the nip between arcuate segment 34*a* and idler roller 66 will hold that portion of sheet S in the nip and will not allow it to advance while the portion of sheet in the nip between arcuate segment 24*a* and idler 66 continues to be advanced by stepper motor $M_1$. As a result, sheet S will rotate substantially about its center C until the motor $M_1$ stops. Such rotation through angle β will "square up" sheet S and alleviate the skew in the sheet relative to path P.

Once the skew has been compensated for, sensor 76 detects the lateral edge of sheet S and generates a signal to logic unit 70 indicating the distance "d" that center C is from $C_L$. Further, a signal from downstream operation station 78 (FIG. 4) indicates that the image transfer station is ready to receive sheet S. This later signal may be based on the location of the lead edge of the image I carried by the film (web W) (FIG. 6). The signal from 78 starts both stepper motors $M_1$ and $M_2$. The arcuate segment 48*a* of third urging roller 48 contacts sheet S as segments 24*a*, 34*a* of rollers 24, 34, respectively, disengage from contact with the sheet. Sheet S is now under the sole control of third urging rollers 48.

Stepper motor $M_3$ is now actuated to drive belt and pulley assembly 50 in the appropriate direction and for an appropriate distance "d" to align center C with centerline $C_L$ of sheet S to provide for the desired cross-tracking of sheet S. The construction and operation of sheet registration mechanism 10 up to this point is identical to that disclosed and fully described in U.S. Pat. No. 5,322,273 and which has been incorporated, in its entirety, herein by reference and which, if deemed necessary, can be referred to for additional details as to the construction and operation of the mechanism.

Some angle of skew (FIG. 1) may remain after sheet S has passed through sheet registration mechanism 10. This angle may be within a tolerance (e.g. ±that which is acceptable for "one-sided" copies) since it is hardly discernable to the naked eye. However, if this skew is not compensated for and an image is copied on the other side of the sheet within a similar tolerance (e.g. ±0.1°), the combined skew α can result in misaligned images of up to twice the original skew error (e.g. ±0.2°).

In accordance with the present invention, the trail edge $L_2$ of side 1 (FIGS. 1 and 2) is detected by both sensors 74*a* and 74*b* as the trail edge moves across these sensors (see FIG. 3). As illustrated, if trail edge $L_2$ remains skewed, sensor 74*b* will detect the sheet S slightly before sensor 74*a* which, in turn, determines and measures the residual skew angle β; i.e. the elapsed time between detection by the respective sensors or the number of additional "clicks" (i.e. steps) that stepper motor $M_1$ continues after motor $M_2$ stops. Also, if the lead edge $L_1$ and the trail edge $L_2$ are not parallel to each other (i.e. miscut), the skew error β (FIG. 1) can also be measured in the same manner. A representative signal of this measurement (e.g. the difference in the number of steps of motor $M_1$ after motor $M_2$ is stopped) is stored in skew error memory 80 (FIG. 4) while the number of that particular sheet is logged into in a counter 81 or the like.

After all of the sheets have made a first pass through the copier and are stacked in order in a duplex tray or transported through a duplex path (not shown), the sheets are then fed from the tray or sequentially arrive from the duplex path, one at a time, back through the copier in the same order wherein a respective image is to be transferred to the other side of each sheet. As each sheet is removed from the tray or is delivered from the duplex path, it is identified in the counter 81 that, in turn, retrieves the skew angle error for that particular sheet from the memory 80. This skew angle error is then applied to the control of stepper motors $M_1$ and $M_2$ so that a new target β is now set at (90°+error angle) instead of 90°, as in the prior art applications. That is, the number of steps representing the skew error for side 1 is added to the control of stepper motor 1 whereby sheet S, when leaving sheet registration mechanism 10 on the second pass, will now be positioned so that the image on side 1 of sheet S will substantially align with the image on side 2 within acceptable tolerances, even if image 1 was slightly skewed relative to sheet S on the first pass.

To further illustrate the present invention, reference is again made to FIGS. 1 and 3. As a particular sheet S makes it first pass through registration mechanism 10, the difference in the number of steps of motors $M_1$ and $M_2$ required to uncover sensors 74*a*, 74*b*, respectively, is measured and a signal representative thereof is stored in memory 80. This measurement also determines $\beta_1$. For example, let $\beta_1$=89.9° or the maximum deviation from 90° for a system that has a tolerance of ±0.1°. If this error is not compensated for, and $\beta_2$ is also equal to 89.9° on the second pass, α will equal 0.1°+0.1° or 0.2° which is twice the error of the single side image with respect to its lead edge and as a result could be outside an acceptable tolerance when viewed through the sheet.

In the present invention, as that particular sheet S is fed back through for a second pass, the skew error for the image on side 1 (i.e. 0.1°) for sheet S is retrieved from memory 80 and is used to set a new target angle for $\beta_2$ at 90.1°. Ideally, this will make the skew angle α (FIG. 1) effectively zero. However, even if the image copied on side 2 still has a skew error of ±0.1°, the tolerance of α (i.e. skew between the image on side 1 and the image on side 2) effectively will be halved from what it would have been without the adjustment of $\beta_2$.

What is claimed is:

1. A method of registering a sheet of a copy medium in a duplex reproduction machine to alleviate the misalignment between the respective images copied on the front and back of said particular sheet, said method comprising:

measuring the error angle of skew between a registration target angle and the trailing edge of said sheet during a first pass before a first image is reproduced on said front of said sheet; and adjusting said registration target angle for said sheet during a second pass to compensated for said error angle of skew wherein any misalignment between said first image and a second image to be reproduced on the back of said sheet is alleviated;

wherein said registration target angle is equal to 90°; wherein said registration target angle for said second pass is adjusted to a valve equal to (90° said error angle of skew);

wherein said error of skew is measured by a pair of sensors located near the top and the bottom of said sheet which sense said trailing edge of said sheet as said sheet passes over said sensors;

wherein said error angle of skew is stored during said first pass and is then retrieved during said second pass.

2. A method of registering a particular sheet of a copy medium in a duplex reproduction machine to alleviate the misalignment between the respective images copied on the front and back of said particular sheet, said method comprising:

measuring the error angle of skew between a desired, registration target angle of 90° and the actual angle of the trailing edge of said particular sheet as said particular sheet passes through a sheet registration mechanism during a first pass wherein an image is to be reproduced on said front of said sheet;

generating a signal representative of said measured error angle of skew;

storing said signal for said particular sheet;

retrieving said signal as said particular sheet is fed for a second pass during which an image is to be reproduced on said back of said particular sheet; and setting a new registration target angle for said sheet registration mechanism which compensates for said error angle of skew before said particular sheet passes through said sheet registration mechanism during said second pass.

3. The method of claim 2 wherein said new registration target angle is equal to (90°+ said error angle of skew).

4. The method of claim 3 wherein said error of skew is measured by a pair of sensors in said sheet registration mechanism which sense the upper and lower portions, respectively, of said trailing edge of said sheet as said sheet passes over said sensors.

5. The method of claim 4 wherein said measurement of said error of skew is derived from the difference of when said respective sensors detect said upper and lower portion of said trailing edge of said sheet.

* * * * *